US007861778B2

(12) United States Patent
Kitzman et al.

(10) Patent No.: US 7,861,778 B2
(45) Date of Patent: Jan. 4, 2011

(54) PRESSURE ORIENTING SWIVEL ARRANGEMENT AND METHOD

(75) Inventors: Jeffery Kitzman, Houston, TX (US); Wesley Byrne, Midland, TX (US); Justin Vinson, Houston, TX (US); Marc Samuelson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 239 days.

(21) Appl. No.: 12/173,467

(22) Filed: Jul. 15, 2008

(65) Prior Publication Data

US 2010/0012378 A1 Jan. 21, 2010

(51) Int. Cl.
*E21B 7/08* (2006.01)

(52) U.S. Cl. ..... 166/255.2; 175/4.51

(58) Field of Classification Search ..... 166/255.2, 166/381; 175/45, 4.51; 285/330, 922
See application file for complete search history.

(56) References Cited

U.S. PATENT DOCUMENTS 5,617,926 A * 4/1997 Eddison et al. ..... 175/61
6,679,327 B2 * 1/2004 Sloan et al. ..... 166/297
7,000,699 B2 * 2/2006 Yang et al. ..... 166/255.2
7,114,564 B2 * 10/2006 Parrott et al. ..... 166/255.2
7,147,060 B2 * 12/2006 Huber et al. ..... 166/381
7,467,672 B2 * 12/2008 Cruickshank ..... 175/61
2009/0084536 A1 * 4/2009 Kenison et al. ..... 166/66

OTHER PUBLICATIONS

Sara Pratt, "A Fresh Angel on Oil Drilling"; Geotimes, Mar. 2004; American Geological Institute; pp. 1-6.
D.A. Castillo and D. Moos, Reservoir Geomechanics Applied to Drilling and Completion Programs in Challenging Formations: North West Shelf, Timor Sea, North Sea and Colombia; APPEA Journal, 2000; GeoMechanics International Inc.; Palo Alto California; pp. 509-521.
Plastic Pipe Institute, "Horizontal Directional Drilling", Handbook of PE Pipe, Chapter 12; Northeast Consulting Inc. and Hosting; 2008; pp. 413-451.

* cited by examiner

*Primary Examiner*—William P Neuder
*Assistant Examiner*—David Andrews
(74) *Attorney, Agent, or Firm*—Cantor Colburn LLP

(57) ABSTRACT

A pressure orienting swivel arrangement includes a freely rotatable weight assembly to orient to gravity prior to being urged to a fixed position. In the fixed position, a pin adapter is reactably interengagable with the weight assembly to orient the pin adapter to the weight assembly without reorienting the weight assembly from gravity. A method for orienting a downhole tool is also included.

14 Claims, 5 Drawing Sheets

PRESSURE ORIENTING SWIVEL ARRANGEMENT AND METHOD

BACKGROUND

In the hydrocarbon recovery industry boreholes are drilled to access hydrocarbon bearing formations for the purpose of extracting target fluids be the fluid gas, oil or a combination of fluids. While traditionally boreholes were drilled substantially vertically and therefore orientation of a bottom hole assembly could be relatively accurately tracked by tracking the orientation of the string at the surface, orientation in highly deviated or horizontal wells that are more common today is difficult and accuracy is limited. This is due in part to the frictional factors encountered as a string of several thousand feet is driven into the low side borehole wall. Because it is difficult to measure the friction all the way up the string, it is difficult to resolve the forces that act on the string and affect actual orientation downhole relative to apparent orientation at the surface.

Being able to accurately determine orientation in the downhole environment facilitates many operational interests. Therefore, the art is always receptive to new methods and apparatus that improve or enable orientation in the downhole environment.

SUMMARY

A pressure orienting swivel arrangement including a weight assembly and a pin adapter reactably interengagable with the weight assembly to orient the pin adapter to the weight assembly.

A pressure orienting swivel arrangement including a housing, a spring compression mandrel within the housing, a spring disposed about the spring compression mandrel, a weight assembly rotatably supported in the housing, and a pin adaptor rotatably supported within the housing and reactably interengagable with the weight assembly to accept a torque from the weight assembly.

A method for orienting a downhole tool including gravitationally orienting a weight assembly, interengaging a pin adapter and inducing rotation in the pin adapter with the weight assembly.

BRIEF DESCRIPTION OF THE DRAWINGS

Referring now to the drawings wherein like elements are numbered alike in the several Figures.

DETAILED DESCRIPTION

Figure 1:
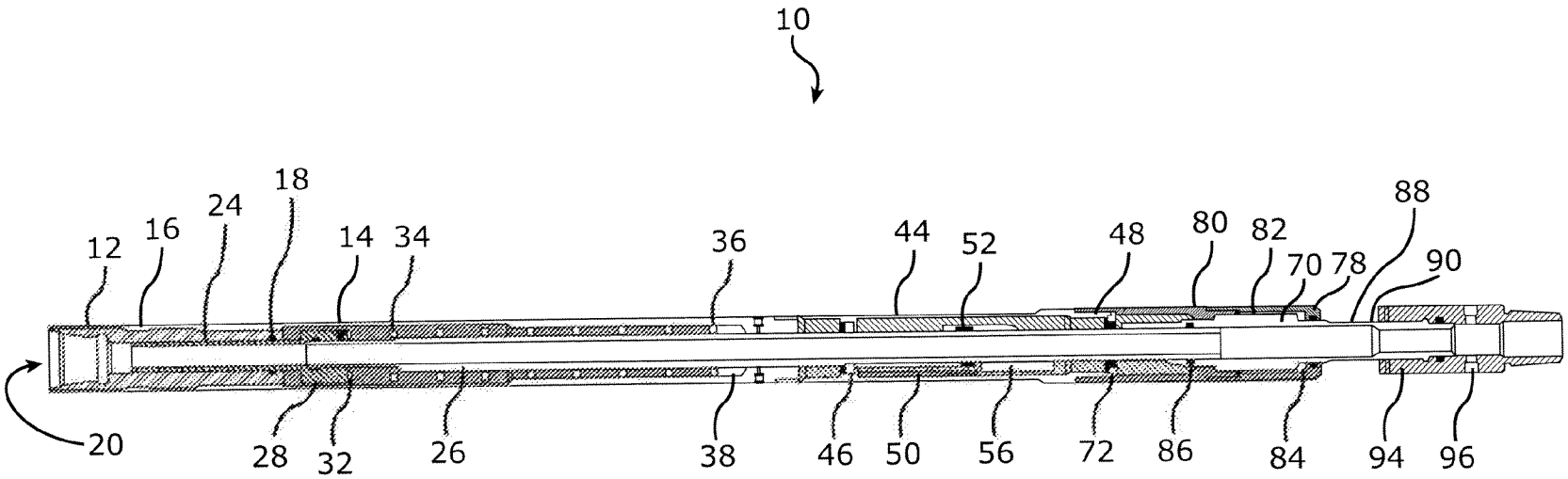
FIG. 1 is a cross section view of one embodiment of a pressure orienting swivel arrangement in a non-actuated position.
Figure 2:
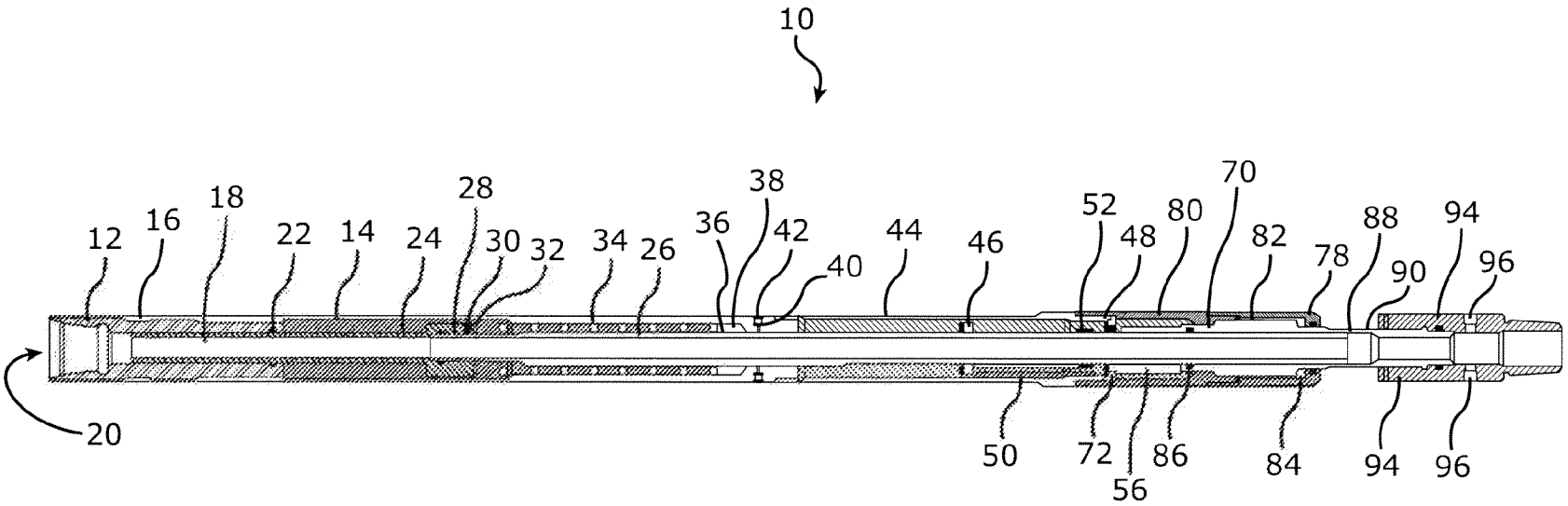
FIG. 2 is a cross section view of one embodiment of a pressure orienting swivel arrangement in an actuated position.

Referring to FIGS. 1 and 2, a non-actuated position and an actuated position, respectively, of one embodiment of a Pressure Orienting Swivel arrangement 10 is illustrated. A comparison of the locations of various component of the arrangement in the two figures will provide an overview for the following description of the individual components and their interactions.

Referring to FIG. 1, and beginning at an uphole end of the arrangement (left side of the figure as per convention) a top sub 12 can be seen. Top sub 12 is fixedly attached to a spring housing 14 at a threaded connection 16. The top sub 12 includes an inside surface 18 that defines the outer most region of a fluid pathway 20 through which pressurization fluid is applied to the arrangement 10 when actuation thereof is desired. Further the top sub 12 includes a seal recess 22 receptive to a seal such as an o-ring (not specifically depicted due to scale, and not needed due to knowledge in the art). Slidably disposed within the inside surface 18 is a seal sleeve 24.

The seal sleeve 24 is attached at a downhole end thereof to a spring compression mandrel 26 at an interconnection point 28. The seal sleeve 24 provides a spring shoulder 30 upon which an uphole end 32 of a spring 34 bears during actuation of the arrangement 10. A downhole end 36 of the spring 34 bears against a bushing 38 or other surface capable of supporting the spring 34 when under compression during actuation of the arrangement.

Adjacent the bushing 38 and through the spring housing 14 is one or more fluid displacement pathway(s) 40 (two shown) within each of which is a filter material 42 in one embodiment of the arrangement 10. This provision allows for fluid to move into or out of the arrangement while the arrangement is being actuated or released from the actuated position to avoid the potential for hydraulic locking or inhibition of movement of the components of the arrangement 10 due to hydraulic forces created by fluid in the arrangement.

Figure 3:
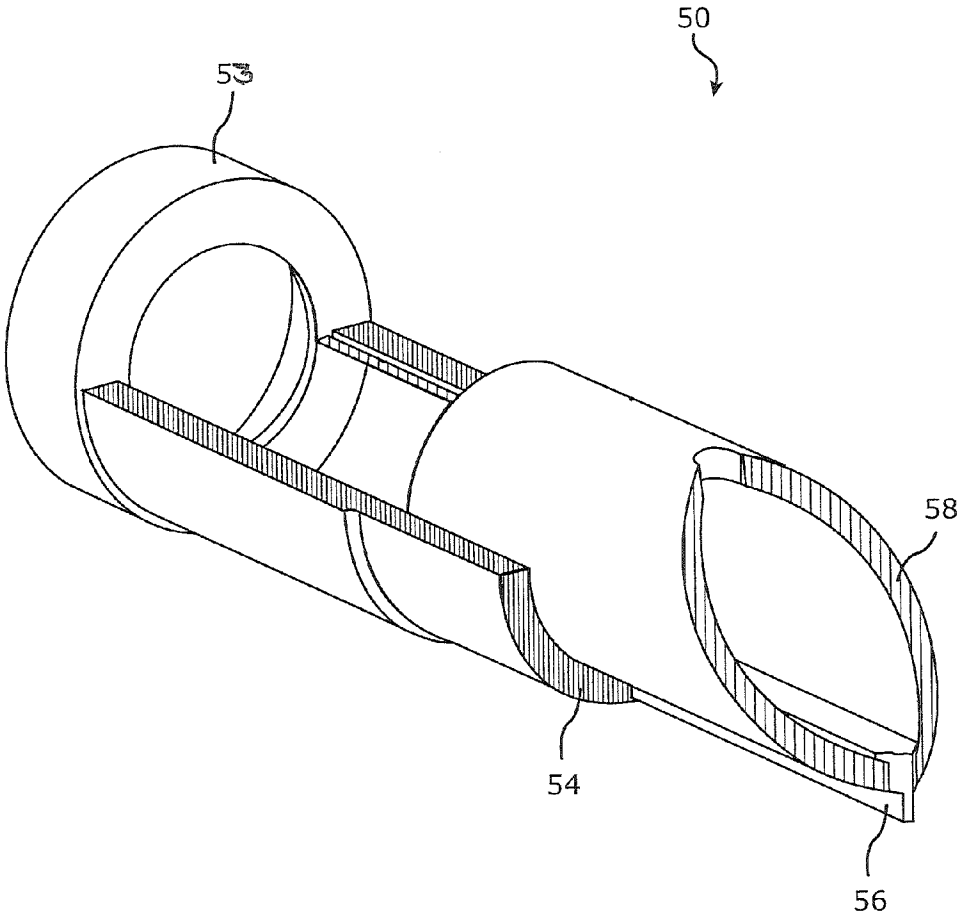
FIG. 3 is a perspective view of a weight assembly of the arrangement.

Downhole of the spring housing 14 and fixedly attached thereto is an extension sleeve 44. The extension sleeve supports a pin 48 fitted to rotationally constrain a gear ring 72. Within the extension sleeve 44, a weight assembly 50 is supported on the spring compression mandrel 26 at bearing 46 and bearing 52. Between the bearings 46 and 52, the weight assembly is balanced axially to promote a relatively frictionless rotational movement within the arrangement 10. This is a useful attribute for the arrangement because it facilitates the self-orientation of the weight assembly 50. Orientation of the weight assembly 50 is important to the function of the arrangement 10. Further the construction of the weight assembly 50 facilitates operation of the arrangement 10. Referring to FIG. 3, an enlarged view of the weight assembly 50 is provided for clarity of its construction. The weight assembly comprises a cage 53, a weight 54, a key 56 and an orientation torque producer 58. It will be appreciated from the figure that the weight 54 extends, in this embodiment, about one half of the cage 53. The purpose of the weight is to cause that the weight assembly 50 orient itself to gravity. In a horizontal or highly deviated well, this ensures that an operator can count on a correct orientation of at least one component in the wellbore. Because the orientation of the weight assembly 50 is known, a desired orientation of another component of the arrangement 10 can be set using the weight assembly 50 as the known. The weight assembly rotates itself only and therefore does not suffer from the drawbacks of prior art devices that have attempted to use an offset weight to orient target tools. Rather the weight assembly as disclosed herein has an overall mass that is substantially concentrated in the weight 54 and therefore only a very small percentage in the cage 53 and key 56.

Importantly then the weight assembly also features an orientation torque producer 58 that functions to orient another component of the arrangement 10 to the weight assembly 50.

Figure 5:
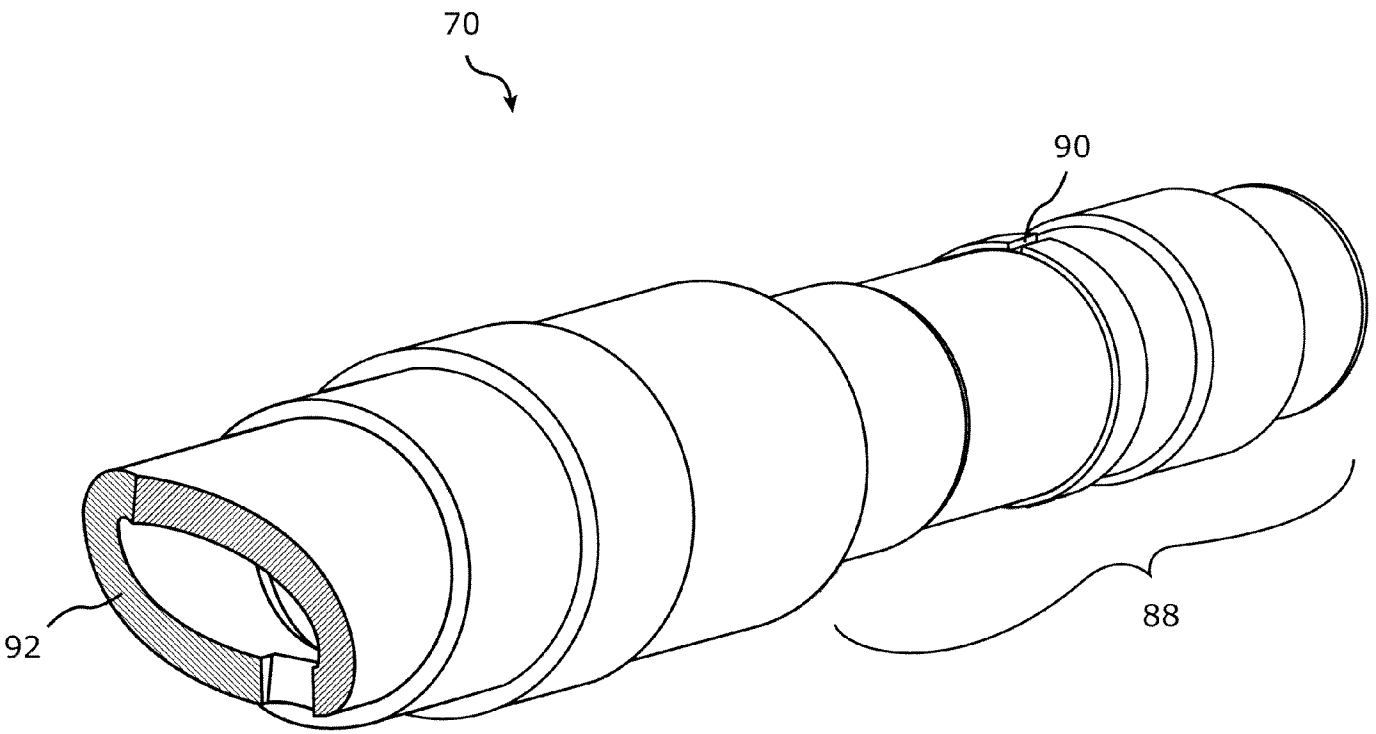
FIG. 5 is a perspective view of a pin adaptor of the arrangement.

It is this function that allows an operator to set a desired orientation of this separate component. The component is a pin adapter 70 identified in FIGS. 1, 2 and 5. Because the weight assembly will find gravity and the pin adapter will orient to the weight assembly, a specifically positioned tool attached to the pin adapter 70 will have a known orientation when the arrangement is actuated.

Figure 4:
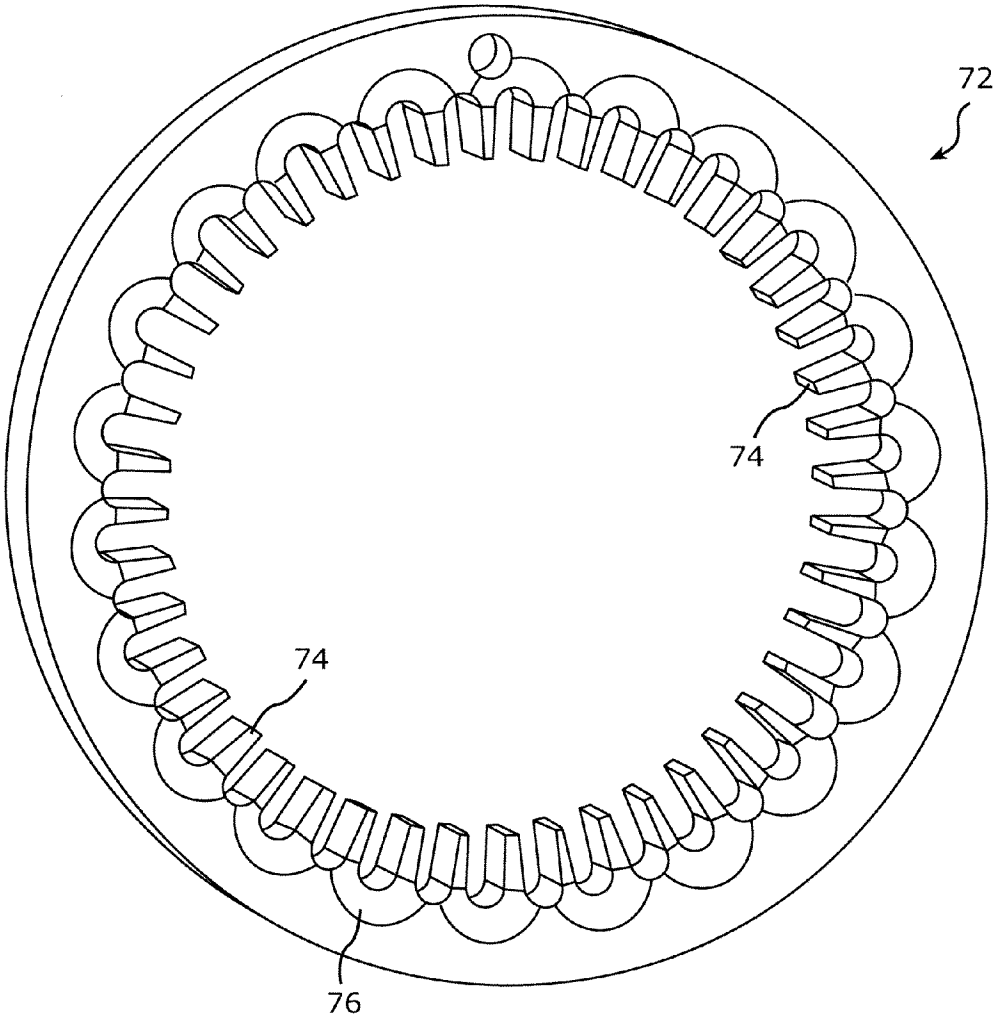
FIG. 4 is a perspective view of a gear ring of the arrangement.

Referring for a moment back to FIGS. 1 and 2, further components of the arrangement 10 are identified to improve clarity of the discussion regarding the actuation of the arrangement. A gear ring 72 is positioned at a downhole end of extension sleeve 44 and is pinned in place rotationally by pin 48. Reference to FIG. 4 makes clear the construction of gear ring 72 including a plurality of gear teeth 74 and lead in ramps 76 to help facilitate engagement therewith by the key 56 to prevent rotational movement of the weight assembly when that assembly is engaged with the gear ring 72. Prevention of rotational movement of the weight assembly means that all of the torque production capability of the orientation torque producer 58, in this embodiment a helical profile, is available to turn the pin adapter 70. The pin adapter rotates within a pin adapter housing 78 which itself is joined to the extension sleeve 44 by a stop sleeve 80. The pin adapter 70, in this embodiment is supported within the housing 78 by a radial type bearing 82 and a thrust bearing 84. A seal 86 is provided between the pin adapter 70 and the spring compression mandrel 26 to seal the arrangement and working with seal 22 for pressure based operation.

At a downhole end of the arrangement 10 (FIGS. 1, 2 and 5) is a pin adapter tail 88 that features an orientation indicator such as a groove 90 that will always be in a position opposed to gravity when the arrangement is actuated because of the interaction between pin adapter 70 and weight assembly 50, which occurs at torque producer 58 of assembly 50 and a complementary profile 92 in this embodiment. The groove thus allows an operator to connect a tool at a specific desired orientation in the wellbore. One such tool is, as illustrated here, a perforation nozzle sub 94 having nozzle receptacles 96. It will of course be understood that any tool could be attached to the pin adapter as desired or required for a particular application.

In operation, the arrangement 10 is assembled at surface with a tool 94 oriented to the groove 90 so that the tool will have the ultimate desired orientation in the wellbore when the arrangement reaches a target depth and achieves the actuated position. The arrangement is then run in the hole until it reaches the target location. Pressure supplied to the pathway 20 acts upon the arrangement to urge a number of its components in the downhole direction. These are the seal sleeve 24, the spring compression mandrel 26 and the weight assembly 50. The spring 34 is compressed by spring shoulder 30 of the seal sleeve 24 during this operation. Since gravity based orientation of the weight assembly 50 has already occurred, since it is continuous until engagement of the key 56 with the gear ring 72, downhole movement of the weight assembly causes the engagement of the key 56 between a pair of teeth of the gear ring 72. Since the gear ring itself is restricted in rotational movement by the pin 48, the weight assembly will now also be prevented from moving rotationally. It is noted that a reduction in pressure on the arrangement 10 will allow the key 56 to disengage from the gear ring and thereby restore rotational movement to the weight assembly under action of the spring 34 but too, a repressurization will reengage the key 56 with the gear ring. This can be repeated as desired. Importantly, and as noted above, the gear ring maintaining the weight assembly rotationless means that upon further pressure based downhole movement of the weight assembly and engagement of the torque producer 58 with the pin adapter 70, all of the torque generated is transferred to the pin adapter 70. Torque on the order of about 70 ft lbs can be generated in one embodiment hereof upon the application of 5,000 psi.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A pressure orienting swivel arrangement comprising:

a weight assembly having at least a position wherein the weight assembly is freely rotatable within a string in which it is installed and a position wherein the weight assembly is rotationally fixed relative to the string in which the weight assembly is installed after orienting itself to gravity during use, the fixed position being acquired responsive to application of pressure against the weight assembly;

a pin adapter reactably interengagable with the weight assembly to orient the pin adapter to the weight assembly upon further application of pressure to the weight assembly, the weight assembly remaining oriented to gravity.

2. The arrangement as claimed in claim 1 wherein the weight assembly includes a key to rotationally lock the weight assembly at a selected position.

3. The arrangement as claimed in claim 1 wherein the weight assembly comprises:

a cage;

a weight attached to the cage at one side thereof;

a key attached to the cage; and a torque producer at the cage.

4. The arrangement as claimed in claim 3 wherein the torque producer is a helical profile.

5. The arrangement as claimed in claim 1 wherein the pin adapter comprises an orientation indicator.

6. The arrangement as claimed in claim 5 wherein the orientation indicator is a groove.

7. A pressure orienting swivel arrangement comprising:

a housing;

a spring compression mandrel within the housing;

a spring disposed about the spring compression mandrel;

a weight assembly rotatably supported in the housing to enable the weight assembly to orient to gravity prior to becoming fixed within the housing;

a pin adaptor rotatably supported within the housing and reactably interengagable with the weight assembly to accept a torque from the weight assembly to orient the pin adaptor to a preset position relative to gravity through interaction with the weight assembly.

8. The arrangement as claimed in claim 7 wherein the pin adapter further includes a torque producer.

9. The arrangement as claimed in claim 8 wherein the torque producer is a helical profile.

10. The arrangement as claimed in claim 8 wherein the pin adapter interengages the weight assembly at the torque producer.

11. A method for orienting a downhole tool comprising:

gravitationally orienting a weight assembly;

interengaging a pin adapter with the gravitationally oriented weight assembly;

inducing rotation in the pin adapter with the weight assembly without reorienting the weight from its gravitationally oriented position.

12. The method as claimed in claim 11 wherein the interengaging comprises pressuring up on the weight assembly.

13. The method as claimed in claim 11 wherein the method further comprises engaging a key of the weight assembly with a rotationally inhibited gear ring prior to interengaging the pin adapter.

14. The method as claimed in claim 11 wherein the method further comprises attaching a separate tool to the pin adapter in a selected orientation relative to an orientation indicator of the pin adapter.

* * * * *